United States Patent [19]

Eichweber

[11] 4,233,882

[45] Nov. 18, 1980

[54] AZIMUTHABLY LAYABLE OR AIMABLE LAUNCHING DEVICE, MORE PARTICULARLY FOR CANISTERS CONTAINING CAMOUFLAGING MEANS OR AGENTS

[75] Inventor: Kurt Eichweber, Hamburg-Niendorf, Fed. Rep. of Germany

[73] Assignee: Precitronic Gesellschaft fur Feinmechanik und Electronic mbH, Fed. Rep. of Germany

[21] Appl. No.: 953,091

[22] Filed: Oct. 20, 1978

[30] Foreign Application Priority Data

Nov. 14, 1977 [DE] Fed. Rep. of Germany ..... 2750776

[51] Int. Cl.[3] ..... F41F 1/00

[52] U.S. Cl. ..... 89/1 L; 102/61

[58] Field of Search ..... 102/5, 61, 89 CD; 89/1 L, 1.5 E, 1.814, 1.815, 1.8, 28 R

[56] References Cited

U.S. PATENT DOCUMENTS

| | | | |
|---|---|---|---|
| 2,925,965 | 2/1960 | Pierce | 102/5 X |
| 3,808,940 | 5/1974 | Schillreff et al. | 89/1 L X |
| 3,974,740 | 8/1976 | Billottet et al. | 89/1 L X |
| 4,063,485 | 12/1977 | Carter et al. | 89/1.814 X |

*Primary Examiner*—David H. Brown

*Attorney, Agent, or Firm*—Prutzman, Kalb, Chilton & Alix

[57] ABSTRACT

A camouflage launching device for launching camouflaging means into an azimuth sector of an incoming transmission beam, having a launching rotor with a plurality of camouflage launching devices and motor driven for being rotated about a vertical axis, to place the rotor in a ready status, a stator with an antenna for receiving an incoming transmission beam from any azimuth, and a plurality of angularly spaced fire transmitters cooperating with fire receivers of the rotor for firing camouflage projectiles from the launching devices into a selective azimuth sector for laying a camouflage within the sector against an incoming projectile.

10 Claims, 6 Drawing Figures

Figure 1:
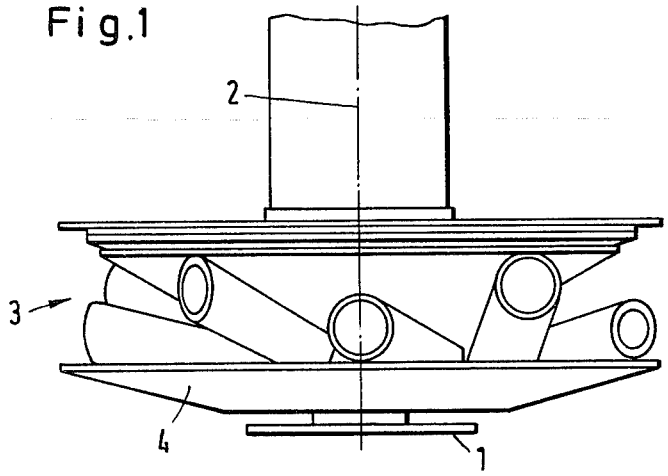

AZIMUTHABLY LAYABLE OR AIMABLE LAUNCHING DEVICE, MORE PARTICULARLY FOR CANISTERS CONTAINING CAMOUFLAGING MEANS OR AGENTS

The present invention relates to an azimuthably layable or aimable launching device, more particularly for detonable canisters containing camouflaging means or agents, provided with a launching guide for the projectile to be launched which is swivel-mounted on a stator around an essentially vertical axis and connected to a firing device.

In weaponry technology it is known to protect an object from enemy detection with the aid of electromagnetic radiation (sight, optical laying or aiming means, laser rangefingers, television laying and aiming devices, heat image units) and by means of aerosols distributed in the atmosphere (Federal Republic of Germany Offenlegungschrift 25 56 256). Metal foil strips, also referred to as chaff or window, are scattered in a suitable manner as a protection by radar. All these means are designated as camouflaging means or agents in the present context. In an extended sense, so-called decoys are classed together with these, that is to say, decoy projectiles that distort, blanket or drown by means of radiation or signals the optical laying or aiming signal directed at the object to be protected and thereby deceive a missile directed thereupon.

It is known, furthermore, in the case where an electromagnetic radiation is received which may be regarded as a warning of an impending bombardment, to automatically launch decoy canisters or packages against the direction of the incoming radiation, in which case the firing may be triggered automatically by the incoming radiation. It goes without saying that this is advisable only if the launching of the camouflaging means or agents is carried out with an adequate degree of aiming accuracy. For this reason known launching apparatuses are equipped with appropriate servo laying or aiming devices. The laying or aiming operation requires a time expenditure of several seconds which, at sea, where, generally speaking, relatively great distances and long projectile flying times are involved, can be tolerated.

For defensive purposes on land, however, by way of example when armored vehicles are involved, the known apparatus is unsuitable since, in this case, distances of less than 1000 m and correspondingly short intervals between the arrival of an enemy measuring beam and the enemy missile have to be expected. It is for this reason that the launching of camouflaging means or agents applied on land is expedient only when it is possible to put up the camouflage screen to be produced within the shortest reaction period possible subsequent to the enemy radiation signal being received.

It consequently is the object of the present invention to provide a launching device as stated in the beginning which it is possible to aim and fire within an extremely short period of time and this, if required, with a plurality of relatively large missiles. The invention further relates to camouflaging means or agents that are particularly well-suited for application in connection with the launching device according to the invention.

The launching device according to the invention is characterized in that the launching guide is drivable in constant rotational motion around the vertical axis of the stator of the launching device and in that the firing or release device consists of a firing or release signal transmitting means arranged on the stator that can be set in conformity with the desired firing or release angle and of a firing or release signal receiving means rotating conjointly with the launching style.

At a sufficiently high velocity of rotation the launching guide is practically at all times located in every arbitrary azimuthal direction. The aimed launching is effected in that the delivery of the projectile to be launched is triggered in each case at the instant when the launching guide is located in the desired direction. While it is time-consuming to accelerate the launching guide together with the projectile rapidly from an initial stationary position into the aiming direction and, once the desired direction has been reached, to decelerate the same again, it is possible to aim the low-weight or weightless firing signal transmitter within fractions of a second. The device according to the invention thus permits a significantly more rapid aimed shot to be fired than with known apparatuses in which it is necessary to aim the entire launching guide assembly.

Expediently, a plurality of annularly arranged launching guides is rotated conjointly around the axis of rotation, in which case it is easy to effect a series launching in that the individual projectiles are fired in each particular case at the instant when their launching guides reach the firing signal transmitter in the desired launching direction. In this way it is possible to produce a camouflage screen by the distribution of detonable canisters or small missiles filled with the camouflaging means or agents across a desired dihedral angle. The lateral displacement of the canisters is achieved by means that are described hereinafter. The elevational displacement may be effected, by way of example, in that the launching guides are arranged at different elevation angles in the rotating annulus. Provision may also be made for the launching guides to be adjustable with respect to their elevation angle and this either by means of an appropriate adjustment prior to the rotational motion being started or, otherwise, by means of elevation aiming devices which are effective during operation. By these means it is possible, depending on the type of the probable attacker (from the ground or from the air), to prepare the device for action. Of course, it would also be possible instead of this to provide the launching device with radially arranged launching guides having all degrees of inclination, thus resulting in the production of a camouflage screen extending almost to the zenith providing a protective curtain against attacks coming from all elevational directions.

For controlling the height, the density and the thickness of the camouflage screen it is also possible to employ other means, e.g. pyrotechnical ones. When the launching device is rotated sufficiently slowly so that the centrifugal forces are controllable, it is also possible to form the axis of rotation for elevational aiming purposes so that it is inclinable with respect to the vertical. For raising the elevation angle into a specific launching direction the axis is inclined into the opposite direction. This does not necessarily lead to any retardation since it is not necessary for the aiming motion to be completely terminated prior to the first firing being effected.

In order to also avoid the aiming motion of the firing signal transmitter, it is possible according to the invention to make provision for a plurality of firing signal transmitters to be distributed on the circumference of the stator, of which that transmitter is activatable for the launching which happens to be located at the desired firing angle. When a certain sector has to be covered it will also be possible to successively activate a plurality of firing signal transmitters that are associated with this sector. By way of example they may be consecutively activated in chronological sequence or, in the case of simultaneous activation, be obliquely offset to the direction of the circles through which the firing signal receivers travel in such a way that they act upon the expediently obliquely offset firing signal receivers at different firing angles. Conversely, the firing signal receivers may also have a different angular displacement with respect to the respective associated launching guide and interact with one and the same firing signal transmitter.

If an arrangement is selected in which both the firing signal receivers and the firing signal transmitters are offset transversally to the direction of rotation, in such a case it will also be possible, instead of using a plurality of firing signal transmitters, to employ a single transmitter appropriately elongated in the transversal direction. It is preferred that its direction be adjustable for the purpose of changing the sector to be covered.

Finally, it is also possible to achieve the desired scattering of the launching angles by making provision for retardation means that produce different time-delay periods while employing a uniform arrangement of both firing signal transmitters and firing signal receivers. These retardation means may be electrical or of any other arbitrary type, e.g. pyrotechnical.

The sector to be covered preferably varies between 10° and 45°.

By way of preference the launching device is automatically controlled by a device for detecting the direction of an incoming radiation and by a device for the automatic delivery of the aiming and the launching pulse.

The launching device and the projectiles ae expediently aimed in such a way that it is possible to apply the camouflage screen at distances of between 50 to 500 m. It is preferred for the camouflage screen to contain an aerosol that is effective within the infrared range. The ratio of reflection to absorption of the camouflaging means or agent within the infrared and/or visual range should resemble as closely as possible that of chlorophyll, that is to say, in the order of magnitude of from 25:75 up to 60:40%, more particularly 60:40%. Moreover, the camouflaging means or agent may comprise metal foil strips as a radar-confusing device. Decoys may be provided as well.

By way of preference the projectiles or canisters are to be conveyed by pyrotechnical means in the form of missiles or rockets. In this case the firing device may be designated as igniting device. However —particularly when the actual range is very short—compressed air may also be employed as energy source. It is also possible to make use of the centrifugal force that is being generated by the rotation of the launching device. It goes without saying that the firing device —due to the design or on account of the lateral motion component of the rotating projectile—does not always have to coincide with the launching direction. It is also possible to make allowance for other influence factors known in ballistics, such as wind, when determining the firing and the delivery direction.

In its application, the launching device according to the invention is not restricted to the reaction to incoming, possibly enemy detection radiation. It may also be employed prophylactically. This applies especially when using a camouflaging agent that is adapted to the optical properties of chlorophyll which, from a longer distance, is not immediately recognizable as a camouflage cloud or screen.

Figure 2:
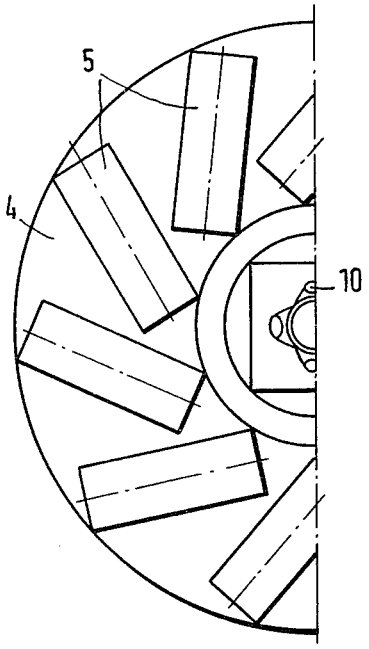
Figure 5:
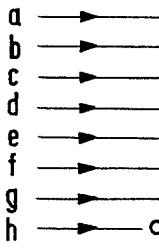
Figure 6:
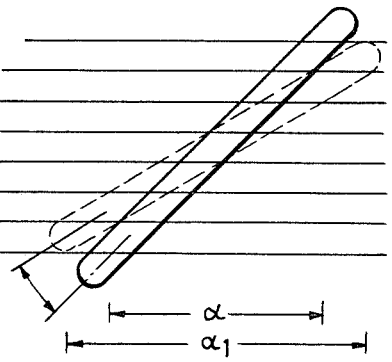

In the following the invention is described in greater detail while reference is made to the accompanying drawings which illustrate advantageous embodiment example. Of these FIG. 1 shows a lateral view, FIG. 2 shows half a top view, FIG. 3 shows half a vertical section, FIG. 4 shows a diagrammatical top view with firing signal receivers and firing signal transmitters, and FIGS. 5 and 6 show a diagrammatical view of firing signal transmitters.

On the base 1 which is rigidly mounted, by way of example on the object to be protected, a power-operated pivot bearing with an axis of rotation 2 for the rotor 3 is arranged, which, for instance, by means of platelike supporting members 4 supports a plurality of launching guides 5 which, in the drawing, are outlined as short pipe sections for the launching of small rockets. Seen from the top, the launching guides may be radially directed, as is indicated in FIG. 4, or, for the purpose of a better utilization of space, according to FIGS. 1 to 3, be arranged obliquely to the radial direction. As can be seen from FIGS. 1 and 3, provision has been made for different inclinations so that the projectiles will release their contents at different heights for the creation of a screen. Instead of this or in addition thereto pyrotechnical means may be provided for the distribution of the contents at the desired camouflaging level.

Figure 3:
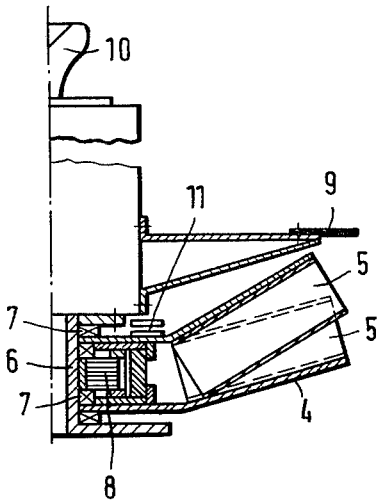

In FIG. 3, at 6, the stator supporting the bearings 7, the motor 8, a protective annulus 9 secured to the stator and covering the stator as well as an antenna 10 for receiving the directional radiation are to be seen. Contactless devices for the transmission of the firing pulse are provided at 11.

Figure 4:
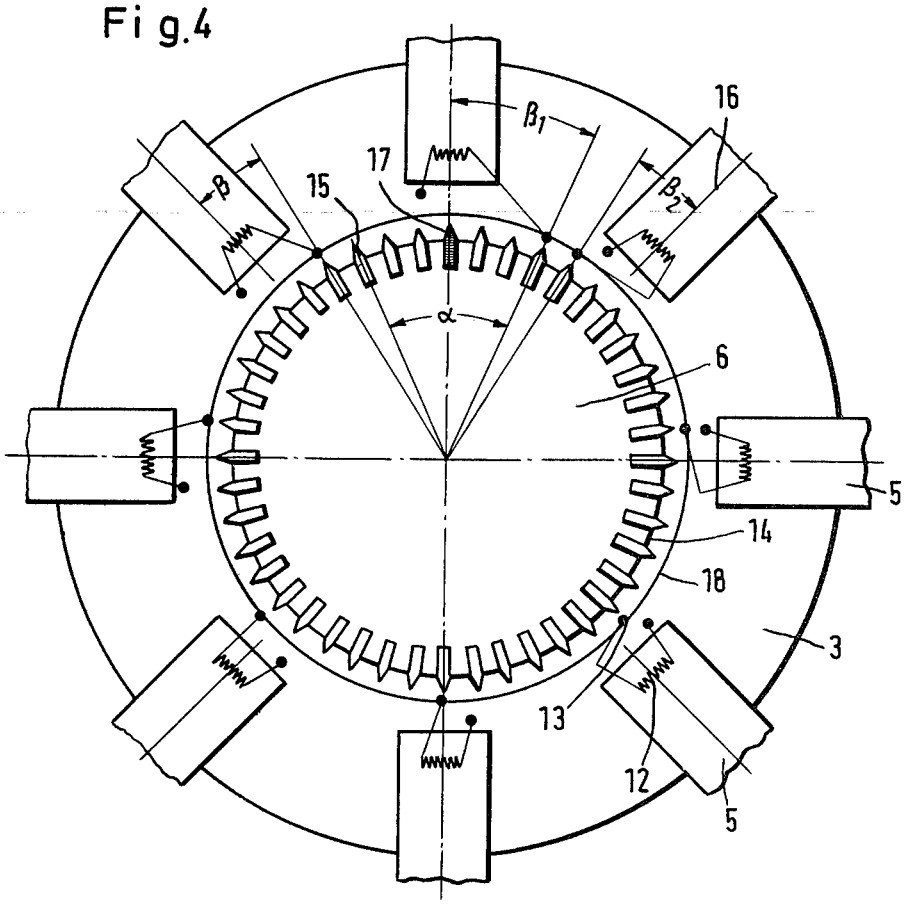

With the aid of FIG. 4 some fundamental conceptions concerning the layout of these transmission facilities are illustrated. In this Figure, at 3, the rotor with launching guides 5 can be seen, of which each (or the projectile disposed therein) is provided with a launching fuse 12 which, on the one hand, is connected to the ground potential and, on the other hand, possesses a firing signal receiver 13 which may be constructed as a contact for the acceptance of an electrical pulse, as a dry-reed contact or in any other arbitrary manner in such a way that it is capable of receiving a launching signal and relaying the same in an appropriate manner to the launching fuse. It is arranged on a rotor surface 18 located oppositely to the stator 6. Provision has likewise been made on this surface for mounting the firing signal receivers of the other launching guides.

The stator surface 14 located oppositely to the rotor surface 18 bears a plurality of firing signal transmitters 15 that are constructed in such a way that they, due to a preferably electrical activating signal, are capable of acting upon the firing signal receivers. If, for example, the firing signal receivers are constructed as electrical contacts, they represent slip ring contacts which consecutively and galvanically make contact with each of the contacts 13. When the firing signal receivers are formed by dry-reed contacts, the firing signal transmitters are electromagnetic points.

Instead of the aforementioned modes of operation a plurality of transmission methods are conceivable that are available to the person skilled in the art without that additional instructions need to be provided, by way of example, inductive or capacitive methods.

If one of these firing signal transmitters is activated, then the projectiles are successively delivered from all the launching guides that pass the transmitter. In this way it is possible to effect within the shortest time possible the launching of a plurality of projectiles in a specific direction without that a longer period of time will be necessary than is required to activate the firing signal transmitter and to rotate the rotor once. When only one firing signal transmitter provided at a specific point of circumference of surface 14 is activated and the firing signal receivers of all the launching guides have the same angular distance from the center line of the pertinent launching guide in each particular instance, the launching direction is equal in all cases. If it is desired to achieve a scattered or dispersed launching direction, then it will be necessary, if it is not desired to fit the individual projectiles or launching guides with different retardation means, to see to it that the transmission of the firing signal takes place in each particular case with a different directional setting of the launching guides. A first way towards achieving this object consists in that the firing signal receivers of the individual launching guides are arranged in different angular positions relative to the respective center axis 16 of the associated launching guides. If, according to FIG. 4, it is desired to scatter or disperse the individual projectiles across the angle alpha, the firing signal receiver 13 must be displaced with respect to the associated center axis 16 by such an angle beta that the oppositely located largest angles alpha-1 and beta-2 complement each other to form alpha and that the other angles beta are located spaced equally between them. The desired scattering results in that case despite the fact that only one activated firing signal transmitter 17 is employed. Instead of this type of displacement of the firing signal receivers in the circumferential direction it is also possible to provide an appropriate displacement on the part of the firing signal transmitters. It will be necessary though in this case to associate with each firing signal receiver a separate firing signal transmitter, which is possible to carry out in that the firing signal transmitters are made to rotate in different circles.

This has been illustrated in FIG. 5 for a non-associated group of firing signal transmitters, each of which is arranged on another circle of rotation which, in each particular case, is associated with a specific receiver. In the illustration these circles of rotation are designated by arrows a to h and appear, assuming that they are arranged side by side on a cylindrical surface and are being viewed in the radial direction, as straight lines. The circumferential distance or spacing of the firing signal transmitters results in the scattering angle alpha. It is seen that the standardization of the series of firing signal transmitters results in an obliquely arranged, elongated shape of a firing signal transmitter as per FIG. 6.

If it is constructed swivelling in the direction of the arrow gamma, then it will permit the change of scattering angle alpha or alpha'.

It is possible to associate with the firing signal receivers of consecutive launching guides different and, at an angle, reciprocally offset firing signal transmitters in that these are successively activated in chronological sequence as and when they are reached by the consecutive receivers. It is possible, for example, to initially activate a series of contiguous firing signal transmitters located in the desired scattering angle, whereupon each firing signal transmitter is deactivated as soon as it is ascertained by an appropriate acknowledgement signal that it has delivered its firing pulse.

In this way, one activated transmitter after the other ceases to be operative with the passing of the launching guides. Operating on the same principle it is also possible to activate a series of consecutive transmitters successively in time with the rotating launching guides.

The device is expediently employed in connection with an apparatus for the automatic detection of enemy measuring or detecting radiation. Such an apparatus is provided with an antenna (or several antennas for different wavelength ranges—e.g. for the radar or infrared range) for the direction-detecting reception of the radiation and a circuit arrangement connected therewith for generating a signal. This signal may supply information to the operating team or serve to automatically deliver means of defence. The apparatus may also be designed to be capable of being changed over for manual or automatic operation.

It is first and foremost armored vehicles that come into question as objects to be protected.

The device is started when the possibility of exposure to danger arises so that the rotor is in constant rotation. When the above-mentioned apparatus receives a radiation which suggests acute danger, it produces a signal that is relayed automatically or manually to the launching device. In the launching device—practically without any time-lag whatever—the firing signal transmitter is activated which is associated with the direction of the received radiation and the projectiles contained in the device are launched in this direction with the desired degree of dispersion. It is possible, of course, to also make provision for only a certain portion of the projectiles to be launched. It is likewise possible to make a selection amongst the available projectiles according to the type of the radiation received or the camouflage desired by manual intervention or as an automatic consequence of the radiation reception.

The projectiles launched dispersedly within the desired dihedral angle release—at a certain distance from the launching site—which distance it is possible to predetermine by known means, their contents, whereby, by likewise known pyrotechnical means, the spreading of these contents in the common plane, i.e. the plane of the camouflage screen to be produced, is being brought about.

The aerosols that are employed as camouflaging agents are expediently mixed in such a way that they are adapted to the mean reflection and absorption values of plant chlorophyll with approximately 40% reflection and 60% absorption. The camouflage screen thus optically matches with its background and conceals the object to be protected without giving away the position of the object due to an optical conspicuousness of the camouflaging agent. Mixtures of extremely finely ground mica, Dixie clay, aluminum powder having a planar structure for producing the reflection effect, aluminized plastics dispersions on the one hand, and soot, extremely finely ground coal (preferably likewise possessing a planar structure), graphite or other substances on the other hand are suited to this purpose. The particle size is adapted to the electromagnetic wavelengths that may be used. The mentioned planar structure does not only favorably affect the absorption or reflection behavior of the particles, but their suspension behavior as well.

In addition to these camouflage agents that are distributed in the form of aerosols it is also possible to employ radiation decoys.

It is possible, of course, to make allowance for the known ballistic influence factors for determining the most favorable launching direction. For instance, the wind force and the wind direction may be taken into account and allowed for when determining the launching direction automatically or based on manual input.

I claim:

1. A camouflage launching device for camouflaging a station with which the device is associated from an incoming projectile, comprising a stator, a launching rotor rotatably mounted on the stator for rotation about a generally upright axis and having at least one camouflage projectile launching guide adapted to be selectively activated for selectively firing camouflage projectile outwardly therefrom into a selected azimuth sector, and a fire signal receiver for each launching guide operable for activating the guide, and motor means for rotating the launching rotor about its upright axis to ready the rotor for camouflaging an azimuth sector of the associated station, the stator comprising a transmission detector for detecting an incoming transmission beam from any azimuth angle, the stator having an annular arrangement of a plurality of fire signal transmitters coaxial with the rotor to operate a fire signal receiver as it rotates thereby and individually selectively operable in accordance with the azimuth angle of a detected incoming transmission beam for selectively operating a fire signal receiver for activating the respective camouflage launching guide for firing a camouflage projectile outwardly into the azimuth sector corresponding to the detected incoming transmission beam.

2. A launching device as claimed in claims 1, characterized in that a plurality of firing signal transmitters (15) is arranged on the circumference of the stator (6), of which the transmitter or transmitters assuming the desired launching angle is or are activatable.

3. A launching device as claimed in claim 2, characterized in that the firing device is designed for contactless signal transmission.

4. A launching device as claimed in claim 1, characterized in that a plurality of launching guides (5) are arranged annularly around the axis of rotation in a conjointly drivable manner.

5. A launching device as claimed in claim 4, characterized in that the launching guides (5) are arranged at different elevation angles.

6. A launching device as claimed in claim 4, characterized in that, for the purpose of angular scattering or dispersion of the projectile launchings, the firing angles of the firing signal receivers associated with the individual launching guides are offset relative to one another.

7. A launching device as claimed in claim 6, characterized in that, for each sector to be covered, one firing signal transmitter is provided which is located elongatedly and obliquely to the direction of the circles of rotation of the reciprocally offset firing signal receivers which intersect the said transmitter.

8. A launching device as claimed in claim 6, characterized in that, for each sector to be covered, one firing signal transmitter is provided which is located elongatedly and obliquely to the direction of the reciprocally offset circles of rotation of the firing signal receivers which intersect the same transmitter, as well as in that the firing signal receiver is offset in a different manner in the direction of rotation with respect to the direction of the associated launching guide.

9. A launching device as claimed in claim 6, characterized in that the firing signal receivers of the individual launching guides or of the firing signal receivers of groups of launching guides are, in each case, associated with one of a plurality of activatable firing signal transmitters having reciprocally offset firing angles that are located in a sector to be covered.

10. A launching device as claimed in claim 9, characterized in that the firing signal transmitters to be activated within a sector to be covered and, accordingly, also the associated firing signal receivers, are arranged, relative to one another, obliquely to the direction of rotation.

* * * * *